US007335060B1

(12) United States Patent
Palinkas

(10) Patent No.: US 7,335,060 B1
(45) Date of Patent: Feb. 26, 2008

(54) INTEGRATED FILTER—CONNECTOR SHIELD

(75) Inventor: Raymond W. Palinkas, Canastota, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/682,712

(22) Filed: Mar. 6, 2007

(51) Int. Cl.
*H01R 9/05* (2006.01)

(52) U.S. Cl. ..... 439/578; 439/607

(58) Field of Classification Search ..... 439/578–585, 439/607–610
See application file for complete search history.

(56) References Cited

U.S. PATENT DOCUMENTS 3,196,382 A 7/1965 Morello
4,097,894 A 6/1978 Tanner
4,163,594 A 8/1979 Aujla
4,168,921 A 9/1979 Blanchard
4,469,386 A 9/1984 Ackerman
4,543,606 A 9/1985 Schaer
4,676,569 A 6/1987 Lambert
4,806,116 A 2/1989 Ackerman
4,824,386 A 4/1989 Souders
5,036,161 A 7/1991 Sachs
5,273,444 A 12/1993 Down
5,297,972 A 3/1994 McMills
5,486,120 A 1/1996 McMills
6,089,912 A 7/2000 Tallis
6,476,688 B2 11/2002 Palinkas
6,491,546 B1 12/2002 Perry
6,848,920 B2 2/2005 Fox
7,059,880 B2 6/2006 McMaster
7,086,877 B1 8/2006 Abbott

*Primary Examiner*—Khiem Nguyen
(74) *Attorney, Agent, or Firm*—Hiscock & Barclay, LLP

(57) ABSTRACT

Disclosed in this specification is a shielding assembly comprised of a contact shield for an electrical connector for a cable television filter. The shield restricts access to the connector from environmental effects, and more specifically, restricts access to the connector from an unauthorized user.

15 Claims, 6 Drawing Sheets

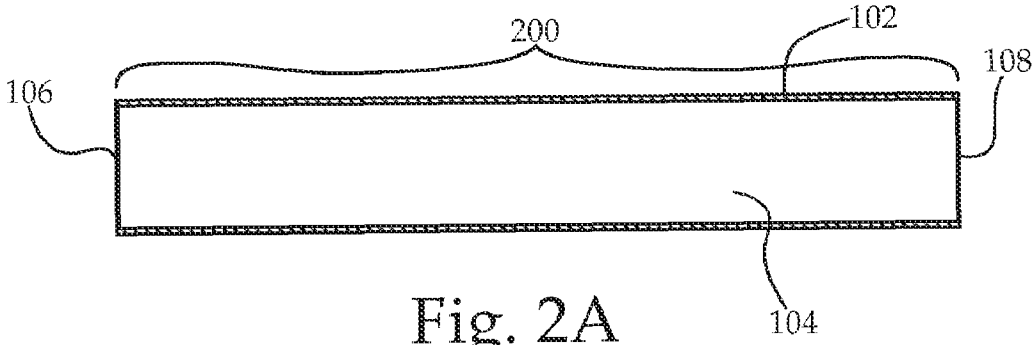
Fig. 2A
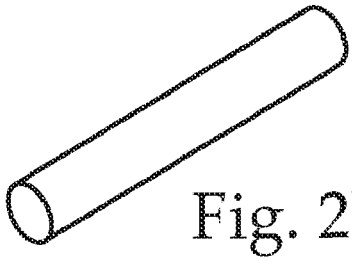
Fig. 2B
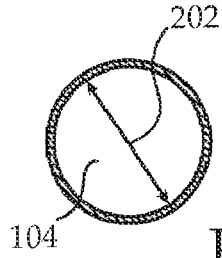
Fig. 2C
Fig. 2

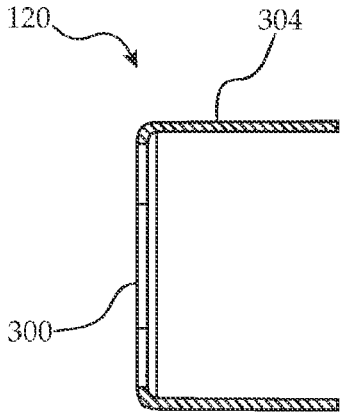
Fig. 3A
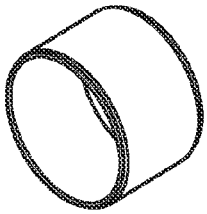
Fig. 3B
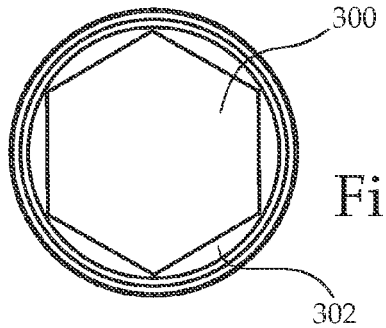
Fig. 3C
Fig. 3

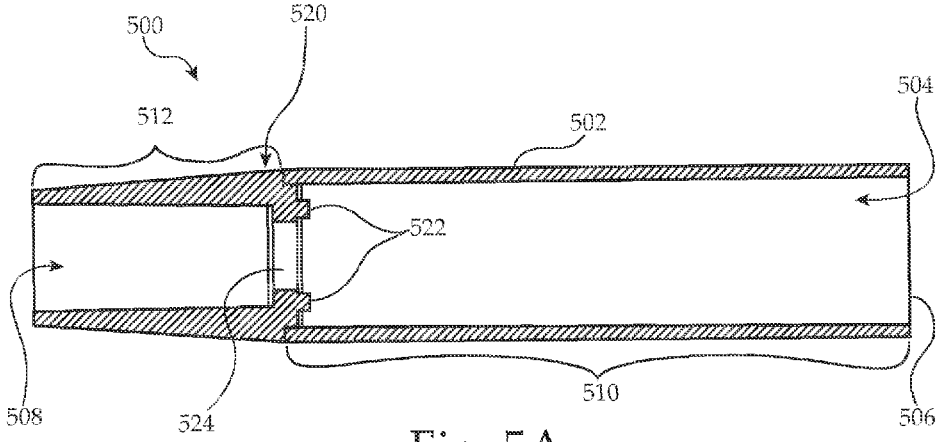
Fig. 5A
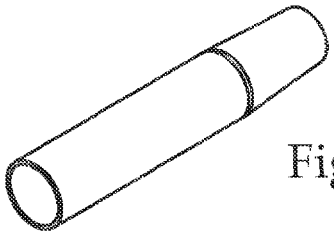
Fig. 5B
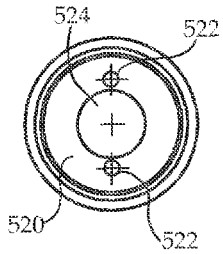
Fig. 5C
Fig. 5

INTEGRATED FILTER—CONNECTOR SHIELD

FIELD OF THE INVENTION

This invention relates, in one embodiment, to a shielding assembly comprised of a contact shield for a filter and/or respective coaxial cable connector. The shield restricts access to the connector from environmental effects, and more specifically, restricts access to the connector from an unauthorized user. The shielding assembly is particularly useful in the field of coaxial cable television connections and filters.

BACKGROUND OF THE INVENTION

The cable television industry has been plagued by individuals who attempt to steal television signals and thus gain access to television programming which the individual did not pay for. The prior art is replete with attempts to increase the security of such television signals. Unfortunately, no single approach has proven entirely satisfactory.

Traditionally, a raw signal containing multiple television channels is transmitted through a coaxial cable. When connecting a subscriber's television service, a cable technician first identifies which channels the subscriber has paid for. The technician then selects an appropriate filter. As would be known by one skilled in the art, filters are also referred to as traps. Such a filter removes (or "traps") those frequencies which the subscriber has not paid for, and thus produces a processed signal that contains only those channels which have been paid for. By selecting which filter is used, the technician permits the subscriber to view only predetermined channels. The aforementioned description is illustrative of one type of filter. Other suitable filters would be apparent to one skilled in the art, and are contemplated for use with the present invention.

Filters/traps are located at the cable television "tap" which is located just outside of the house, in one of two locations—at the telephone pole or in a pedestal on the ground. Traps that block signals are not located in the house.

In the first approach the cable provider attempts to prevent access to the filter itself by foiling any attempt to disconnect the filter from the coaxial cable. Examples of such approaches include U.S. Pat. Nos. 4,543,606 to Schaer (Security Device for Cable Television); 4,097,897 to Tanner et al. (Secured Scramble Decoder Filter); 6,476,688 to Palinkas (Filter Assembly); 4,806,116 to Ackerman (Combination Locking and Radio Frequency Interference Shielding Security System for a Coaxial Cable Connector); 5,036,161 to Sachs (Top Shield Arrangement for Filter Traps); 4,676,569 to Lambert et al. (Protective Cover for Cable Television Distribution Taps); and the like. The content of each of the aforementioned patents is hereby incorporated by reference into this specification.

In the second approach, the cable provider attempts to prevent disconnection of the connectors that transmit the cable signal (i.e. prevent removal from the tap). Examples of such approaches include U.S. Pat. Nos. 7,059,880 to McMaster (Coupling Device for Coaxial Cable and Communication Applications); 7,086,877 to Abbott (Terminator Locking Cover System); 6,848,920 to Fox (Method and Assembly for Connecting a Coaxial Cable to an Externally Threaded Connecting Part); 6,491,546 to Perry (Locking F Terminator for Coaxial Cable Systems); 5,273,444 to Down et al. (Tamper-Resistant Cable Terminator System); 4,824,386 to Souders (Security Connector Assembly for Mating Coaxial Connectors); 4,469,386 to Ackerman (Tamper-Resistant Terminator for a Female Coaxial Plug); 4,168,921 to Blanchard (Cable Connector or Terminator); 4,163,594 to Aujla (Electrical Connector); and the like. The content of each of the aforementioned patents is hereby incorporated by reference into this specification.

To successfully stop an attempt to modify a television signal, a cable technician will often use both methods simultaneously. Unfortunately, the use of multiple security devices produces further complications. To install or remove such a security device, a specialized tool is often necessary. When two such devices are necessary (a first device to protect the filter and a second device to protect the connector), then the technician must be equipped with two separate tools and separate shielding assemblies. This increases the expenses of the cable provider and thus increases the cost of the cable services so provided. Some attempts to provide multipurpose device has been made. For example, U.S. Pat. Nos. 5,297,972 (Coaxial Cable Connection Protection System) and 5,486,120 (Coaxial Cable Connection System with Multiple Chambered, Flexible-Webbed Shroud), both to McMills et al., teach a shielding assembly that can be adapted to house either a connector or a filter. Unfortunately, McMills does not provide a single device capable of both, thus multiple devices are still necessary.

Therefore, a shielding assembly that secures both the connector and the filter is desired.

A shielding assembly is also desired which permits the technician to select whether the filter is non-rotatably engaged with the security shield or rotatably engaged.

Further, a shielding assembly that can be easily assembled and disassembled using specialized tool is desired. When the filter is non-rotatably engaged, a single specialized tool may be used to access the assembly. When the filter is rotatably engaged, then two specialized tools are used to access the assembly. Preferably, the two specialized tools are identical.

SUMMARY OF THE INVENTION

The invention comprises, in one form thereof, a shielding assembly for securely enclosing a filter and a coaxial cable connector within a single security shield, thus preventing tampering.

More particularly, the invention includes a locking mechanism for selecting whether or not the filter can rotate within the shield.

In another form, the invention includes a method for securely enclosing a filter and coaxial cable connector.

One advantage of the present invention is that the device is unitary and is more resistant to physical damage than prior art security devices.

A further advantage of the present invention is that the assembly can be installed and removed with a single special tool. Prior art devices require at least two separate tools—one for the filter shield and a second for the connector security shield. Additionally the present invention requires fewer materials and is simpler to install than prior art devices.

BRIEF DESCRIPTION OF THE DRAWINGS

The present invention is disclosed with reference to the accompanying drawings, wherein:

FIG. 2, which includes FIGS. 2A, 2B, and 2C are schematic, perspective, and end views of one shield for use with the present invention;

FIG. 3, which includes FIGS. 3A, 3B, and 3C are schematic, perspective, and end views respectively, of one divider of the instant invention;

FIG. 5, which includes FIGS. 5A, 5B, and 5C are schematic, perspective, and end views of another shield for use with the present invention.

Corresponding reference characters indicate corresponding parts throughout the several views. The examples set out herein illustrate several embodiments of the invention but should not be construed as limiting the scope of the invention in any manner.

DETAILED DESCRIPTION OF A PREFERRED EMBODIMENT

Figure 1:
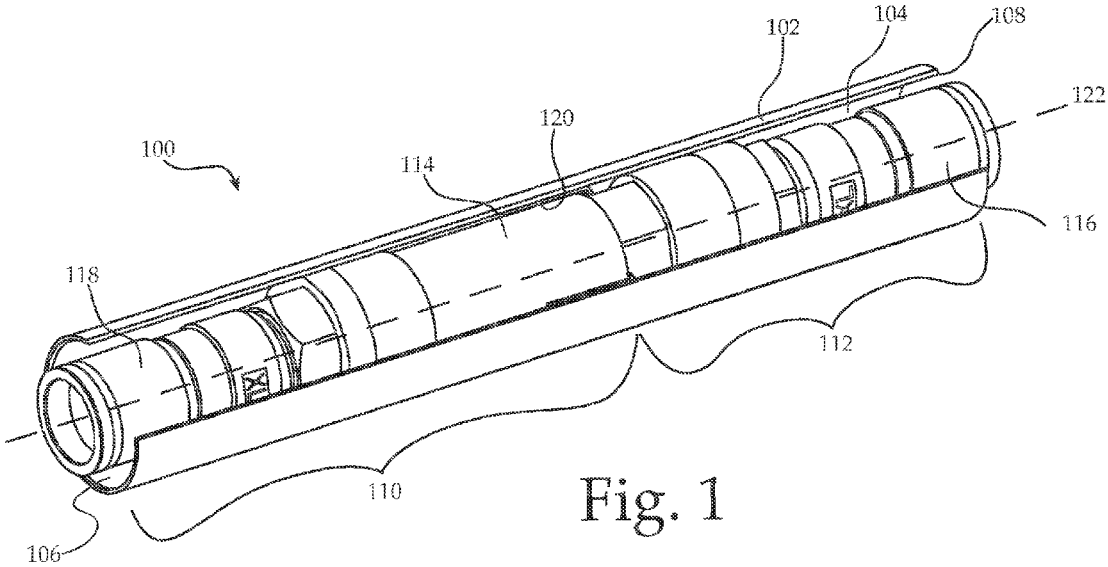
FIG. 1 is a perspective view of one shielding assembly of the present invention.

Referring to FIG. 1, there is shown shielding assembly 100 of the present invention. In the embodiment depicted, shielding assembly 100 is comprised of shield 102 which, in turn, is comprised of receptacle area 104, proximal opening 106 and distal opening 108. For clarity of illustration, part of shield 102 has been cut away so as to more clearly show the contents of receptacle area 104. Receptacle area 104 includes filter receiving area 110 and connector receiving area 112. Removably disposed within filter receiving area 110 is filter 114. Likewise, removably disposed within connector receiving area 112 is connector 116. Filter 114 and connector 116 are both coaxial with respect to central axis 122 each component is directly connected to its counterpart. In the embodiment depicted, second connector 118 is also removably disposed within filter receiving area 110. In some embodiments, second connector 118 is substantially identical to connector 116. In such embodiments, only a single special tool is necessary to access both ends of assembly 100. Divider 120 separates filter receiving area 110 and connector receiving area 112.

Filter 114 can be any suitable filter known in the art or any other means for filtering/attenuating a television signal. In one embodiment, the filter has fittings at both of its ends that are the same. For example, both fitting may be male threads. Likewise, connector 116 may be any suitable connector used in the art or any other means for connecting to a coaxial cable. For example, in one embodiment the connector is a common F connector. As is known to those skilled in the art, such F connectors are configured to a threaded female nut adapted to receive a male thread. The coaxial cable is disposed in the center of the nut. Reference may be had to U.S. Pat. Nos. 3,196,382 to Morello (Crimp type Coaxial Cable Connector); 6,089,912 to Tallis et al (Post-less Coaxial Cable Connector); and the like. The content of each of the aforementioned patents is hereby incorporated by reference into this specification.

Referring now to FIG. 2, and the embodiment depicted therein, FIG. 2 illustrates shield 102 of FIG. 1. Shield 102 is preferably made from a durable material that resists damage. In one embodiment, shield 102 consists essentially of stainless steel. In the embodiment depicted, shield 102 is unitary (i.e. a single piece). Such a unitary configuration increases the overall strength of the shielding assembly and helps securely enclose the elements disposed within receptacle area 104. In another embodiment, the assembly 100 is substantially weatherproof. FIG. 2A is a schematic illustration of shield 102, whereas FIG. 2B is a perspective view of the same. FIG. 2C depicts the end of shield 102. The length 200 of shield 102 is selected to securely enclose at least filter 114 and connector 116. In the embodiment depicted in FIG. 1, the length 200 was selected to securely enclose filter 114, connector 116, and second connector 118. In the embodiment depicted in FIG. 2, shield 102 has a length 200 of from about 7 cm to about 16 cm, and more preferably from about 9 cm to about 11 cm. In the embodiment depicted in FIG. 2, shield 102 is cylindrical. Other shield shapes are also contemplated for use with the present invention. For example, in one embodiment, the shield is hexagonal such that it is easily gripped by a common wrench. In another embodiment, the shield is rectangular.

As used in this specification, the term "securely enclosed" means to enclose such that an unauthorized user is substantially prevented from accessing the element in question unless a special tool, not generally available to the pubic, is used. For example, when filter 114 and connector 116 are securely enclosed within shield 102, shield 102 obstructs an unauthorized user from accessing both filter 114 and connector 116. Thus shield 102 is one means for securely enclosing filter 114 and connector 116. A specialized tool, not generally available to the public, is required to access such securely enclosed elements. Such specialized tools are selected to match the particular security device being used. Examples of such specialized tools are found in the prior art. Reference may be had, for example, to FIG. 7 and FIG. 8 of U.S. Pat. No. 6,848,920. Many other suitable specialized tools would be readily apparent to those skilled in the art.

Referring again to FIG. 2, shield 102 has an inner diameter 202 selected to correspond to the diameter of the filter 114 and connector 118. In the embodiment shown in FIG. 2, the inner diameter of the shield 102 is the same over the entire length 200 of shield 102. In a first embodiment, shown in FIG. 2, the inner diameter 202 is from about 1 cm to about 2 cm. In one such embodiment, the inner diameter 202 is about 1.5 cm. In a second embodiment, shown in FIG. 5, the inner diameter of the shield 102 varies over the length of the shield to as to accommodate different filter and connectors. In the embodiment depicted in FIG. 2, the divider 120 (see FIG. 1), which separates the filter and connector, has not been installed.

FIG. 3, which includes FIG. 3A, FIG. 3B, and FIG. 3C, are depictions of divider 120 prior to installation in shield 102. Divider 120 is comprised of aperture 300, locking mechanism 302, and supporting wall 304. Aperture 300 is configured to engage filter 114. Advantageously, aperture 300 is perpendicular to the walls of shield 102, thus promoting the proper mating of filter 114 and aperture 300. Supporting wall 304 has a length designed to be contiguous with the walls of shield 102 (see FIG. 1 and FIG. 4). Supporting wall 304 is also perpendicular to aperture 300. When divider 120 is disposed within shield 102, supporting wall 304 promotes a perpendicular configuration between aperture 300 and the walls of shield 102 and prevents the aperture 300 from becoming misaligned. In the embodiment depicted in FIG. 3, locking mechanism 302 is comprised of six flat walls which provide aperture 300 with a hexagonal shape. This hexagonal shape is designed to non-rotatably engage mated end 408 of filter 114 (see FIG. 4), thus aperture functions as one means for engaging filter 114. The precise shape of aperture 300 is selected to match the shape of the mated end 408 of filter 114. Thus, for example, if the mated end of filter 114 were triangular (i.e. three flat walls), then aperture would likewise be triangular. If four flat walls were so provided, then the aperture would have a square or rectangular shape. If two flat walls were provided, then the aperture would have the shape of a square with two non-flag edges. By way of further illustration, and not limitation, if the mated end of filter 114 were comprised of female recesses, then the aperture would be configured with corresponding male protrusions.

As used in this specification, the term "mated" refers to the female/male matching of a receiving aperture and an extending protrusion of similar shape that that rotation is locked. Engagements between two parts may be mated (i.e. locked, fixed, or non-rotatable) or non-mated (i.e. unlocked, non-fixedly engaged, or rotatable).

Figure 4:
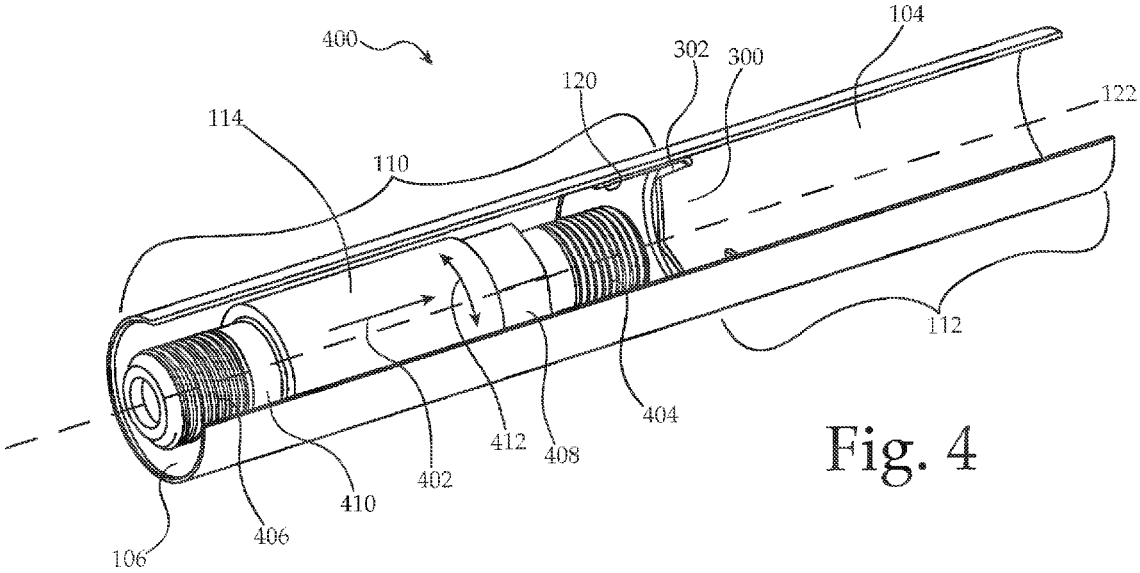
FIG. 4 is a perspective view of another partially assembled shielding assembly.

FIG. 4 is an illustration of a partially assembled shielding assembly 400 similar to assembly 100 of FIG. 1. In the embodiment depicted in FIG. 4, divider 120 has been inserted into receptacle area 104. In this manner, filter receiving area 110 and connector receiving area 112 have been defined. Filter receiving area 110 is on a first side of the aperture 300 and connector receiving area 112 is on a second side that is opposite the first side of aperture 300. Generally, filters are larger than connectors, and thus filter receiving area 110 is typically larger than connector receiving area 112. In the embodiment depicted in FIG. 4, filter 114 has been disposed in filter receiving area 110 by inserting distal end 404 into proximal opening 106 and thereafter moving filter 114 in the direction of arrow 402.

The filter 114 illustrated in FIG. 4 is comprised of distal end 404, proximal end 406, mated end 408 and non-mated end 410. As discussed elsewhere in this specification, the shapes of mated end 408 and aperture 300 are selected such that each component will mate with the other. In the embodiment depicted in FIG. 4, mated end 408 has a male hexagonal shape and aperture 300 has a mated, female hexagonal shape formed by locking mechanism 302.

It is noteworthy that filter 114 only has a mated end 408 on its distal end 404. The proximal end 406 has a non-mated end 410 that will not mate with aperture 300. By selecting which end is placed into proximal opening 106 first, the technician can select whether or not the locking mechanism 302 engages with filter 114. In one embodiment, shown in FIG. 4, distal end 404 is placed into proximal opening 106 first, thus mated end 408 fixedly engages locking mechanism 302 and prevents the rotation of filter 114 about central axis 122 in the direction of arrow 412. In another embodiment, not shown, proximal end 406 is placed into proximal opening 106 first, thus non-mated end 406 does not fixedly engage locking mechanism 302. In this manner, filter 114 is rotatably engaged with locking mechanism 302 and allows rotation of filter 114 in the direction of arrow 412.

FIG. 5 is a depiction of another shielding assembly 500 for use with the present invention. Assembly 500 is similar to assembly 100 of FIG. 1, but differs therefrom in that the shield 502 and divider 520 are unitary. Additionally, the locking mechanism 522 has a configuration that differs from the configuration of locking mechanism 302.

As illustrated in FIG. 5, FIG. 5A, FIG. 5B and FIG. 5C, shielding assembly 500 is comprised of shield 502, receptacle area 504, proximal opening 506, distal opening 508, divider 520, aperture 524, and locking mechanism 522. Divider 520 defines the barrier between filter receiving area 510 and connector receiving area 512, while aperture 524 permits an electrical connection to be established between components that may be disposed within such receiving areas 510/512. Locking mechanism 522 is configured to mate with a mated end present on one end of a corresponding filter (not shown). When such a mated end is engaged with locking mechanism 522, rotation of the filter is prevented as discussed elsewhere in this specification. When the non-mated end is engaged with locking mechanism 522, rotation of the filter is permitted. Two suitable locking mechanisms (302 and 522) have been described in this specification. However, other suitable locking mechanisms will be apparent to those skilled in the art after benefiting from reading this specification. Such locking mechanisms are considered within the scope of the present invention.

Figure 6:
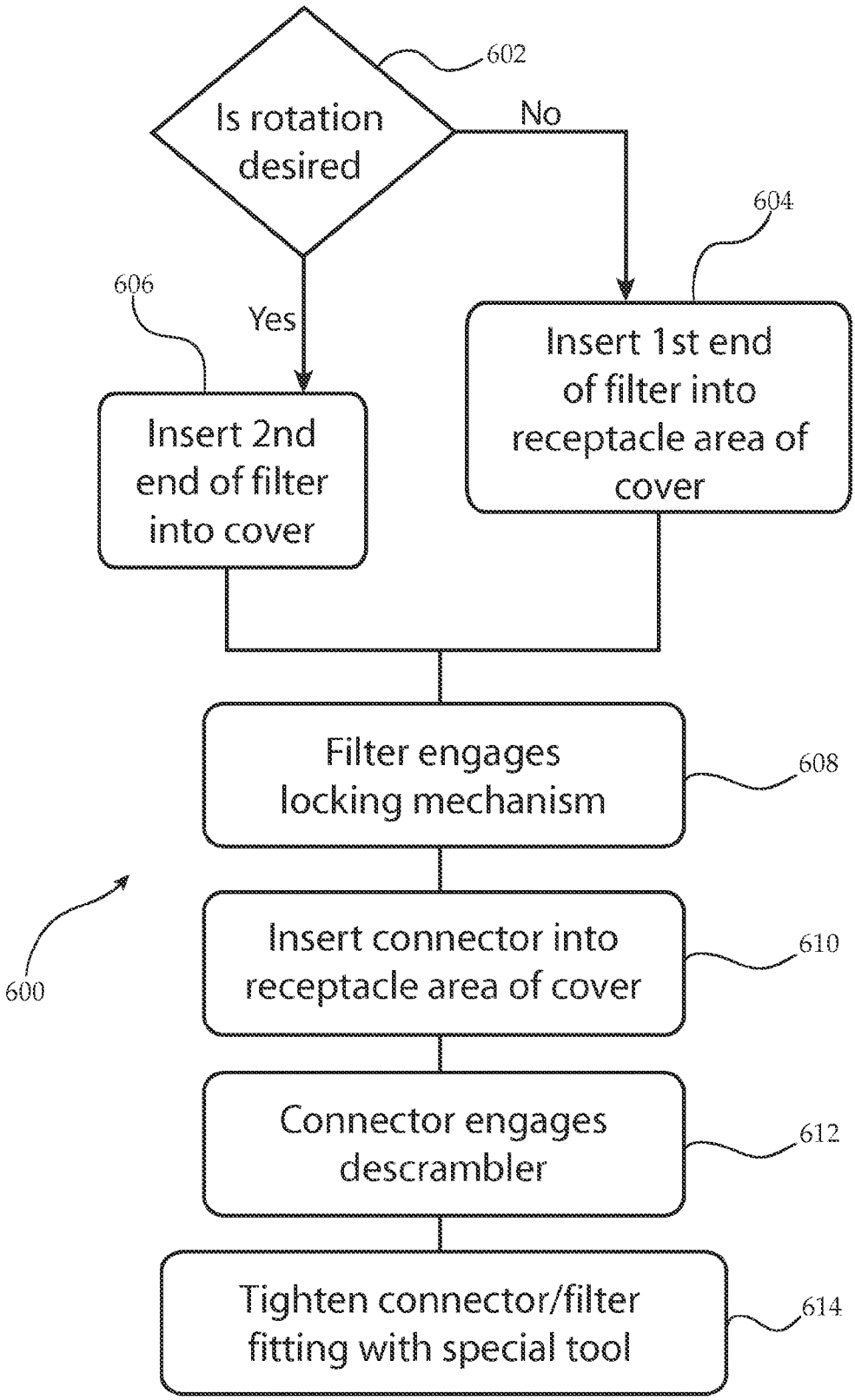
FIG. 6 is a flow diagram of one process of the invention.

FIG. 6 is a flow diagram describing process 600 for use with the present invention. In the embodiment depicted in FIG. 6, process 600 is initiated by executing step 602, wherein an operator of the assembly decides whether or not rotation of the filter is desired. If rotation is desired, step 606 is executed. If rotation is not desired, step 604 is executed. When rotation is not desired (i.e. step 604), a first end of the filter is inserted into the receptacle area of a shield so as to place the first end in contact with a locking mechanism disposed within the receptacle area. The first end and the locking mechanism are configured to have mating ends such that rotation is not possible. When rotation is desired (i.e. step 606), a second end of the filter is inserted into the receptacle area of the shield so as to place the second end in contact with the locking mechanism. The second end and the locking mechanism are configured to have non-mating ends such that rotation is possible. Once the filter has been placed within the receptacle area in accordance with steps 602-606, the filter end becomes engaged with respect to the locking mechanism in step 608. If rotation is desired, then the engagement is a rotatable (i.e. mated) engagement. If rotation is not desired, then the engaged is a fixed (i.e. non-rotatable, or non-mated) engagement.

Referring again to FIG. 6 and step 610 of process 600, once the filter is disposed within the receptacle area of the shield and suitably engaged with the locking mechanism, a connector is inserted into the receptacle area of the shield. The connector engages the filter in step 612 such that the two components are in electrical communication. In step 614 the connector/filter fitting is tightened with a specialized tool. Since both the connector and the filter are securely enclosed with the receptacle area, use of a specialized tool, as discussed elsewhere in this specification, is necessary.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

Element Index

| | | | |
|---|---|---|---|
| 100 | Shielding assembly | 102 | Shield |
| 104 | Receptacle area | 106 | Proximal opening |
| 108 | Distal opening | 110 | Filter receiving area |
| 112 | Connector receiving area | 114 | Filter |
| 116 | Connector | 118 | Second connector |
| 120 | Divider | 122 | Central axis |
| 200 | Length | 202 | Inner diameter |
| 300 | Aperture | 302 | Locking mechanism |
| 304 | Supporting wall | | |
| 400 | Shielding assembly | 402 | Arrow |
| 404 | Distal end | 406 | Proximal end |
| 408 | Mated end | 410 | Non-mated end |
| 412 | Arrow | | |

-continued

| Element Index | | | |
|---|---|---|---|
| 500 | Shielding assembly | 502 | Shield |
| 504 | Receptacle area | 506 | Proximal opening |
| 508 | Distal opening | 510 | Filter receiving area |
| 512 | Connector receiving area | 520 | Divider |
| 522 | Locking mechanism | 524 | Aperture |
| 600 | Process | 602-614, | Steps |

What is claimed is:

1. A shielding assembly comprising a shield, a filter for filtering television cable signals, and a first connector for connecting to a coaxial cable, such that:

a. said filter has a distal end and a proximal end, b. said shield is comprised of a receptacle area with a filter receiving area for receiving said filter such that said filter is securely enclosed by said shield, a connector receiving area for receiving said first connector such that said first connector is securely enclosed by said shield, and a divider separating said filter receiving area from said connector receiving area, said divider being comprised of:

i. an aperture connecting said filter receiving area and said connector receiving area such that one end of said filter passes through said aperture and extends into said connector receiving area and connects to said first connector, said aperture having an inner diameter that is less than the inner diameter of said shield, and ii. a locking mechanism configured to mate with said distal end of said filter such that said filter cannot rotate within said shield when so mated, and configured to non-fixedly mate with said proximal end of said filter such that said filter can rotate within said shield when so mated.

2. The shielding assembly as recited in claim 1, wherein said first connector is a F connector.

3. The shielding assembly as recited in claim 2, further comprising a second connector disposed within said filter receiving area and connected to said filter.

4. The shielding assembly as recited in claim 1, wherein said shield is generally cylindrical.

5. The shielding assembly as recited in claim 2, wherein said shield is from about 7 cm to about 16 cm long with an inner diameter of from about 1 cm to about 2 cm.

6. The shielding assembly as recited in claim 2, wherein said shield is unitary.

7. The shielding assembly as recited in claim 6, wherein said shield and said divider are unitary.

8. The shielding assembly as recited in claim 6, wherein said shield consists essentially of stainless steel.

9. The shielding assembly as recited in claim 8, wherein said locking mechanism is comprised of at least two flat walls.

10. The shielding assembly as recited in claim 9, wherein said aperture is hexagonal.

11. The shielding assembly as recited in claim 8, wherein said assembly is substantially weatherproof.

12. The shielding assembly as recited in claim 6, wherein the inner diameter of said shield is substantially equal over the length of said shield.

13. The shielding assembly as recited in claim 6, wherein said first connector is substantially identical to said second connector such that a specialized tool operates said first connector and said second connector.

14. A shielding assembly comprised of a. means for filtering a television cable signal, b. means for connecting to a coaxial cable, wherein said means for connecting is directly connected to said means for filtering, c. means for engaging to both said means for filtering and said means for connecting, wherein said means for filtering is further comprised of means for rotatably engaging to said means for engaging, and said means for filtering is further comprised of means for non-rotatably engaging to said means for engaging, d. means for securely enclosing said means for filtering, said means for connecting, and said means for engaging.

15. The shielding assembly as recited in claim 14, wherein said means for connecting to a coaxial cable is an F connector.

* * * * *